US008116960B2

(12) United States Patent
Deml et al.

(10) Patent No.: US 8,116,960 B2
(45) Date of Patent: Feb. 14, 2012

(54) METHOD FOR OPERATING A COMBUSTION MACHINE, DEVICE FOR OBTAINING THERMAL ENERGY, AND MOTOR VEHICLE

(75) Inventors: Ulrich Deml, Lappersdorf (DE); Carsten Götte, Pentling/Grossberg (DE)

(73) Assignee: Continental Automotive GmbH, Hannover (DE)

( * ) Notice: Subject to any disclaimer, the term of this patent is extended or adjusted under 35 U.S.C. 154(b) by 397 days.

(21) Appl. No.: 12/375,995

(22) PCT Filed: May 31, 2007

(86) PCT No.: PCT/EP2007/055352

§ 371 (c)(1),
(2), (4) Date: Feb. 2, 2009

(87) PCT Pub. No.: WO2008/040570

PCT Pub. Date: Apr. 10, 2008

(65) Prior Publication Data

US 2009/0312934 A1 Dec. 17, 2009

(30) Foreign Application Priority Data

Oct. 4, 2006 (DE) ..... 10 2006 046 983

(51) Int. Cl.
*G06F 19/00* (2011.01)
*F02D 41/14* (2006.01)

(52) U.S. Cl. ..... 701/102; 701/109; 701/117

(58) Field of Classification Search ..... 123/672, 123/676–679; 701/101–103, 109, 114, 115, 701/117; 60/274, 276; 95/11, 12, 14, 21, 95/139, 140; 96/130
See application file for complete search history.

(56) References Cited

U.S. PATENT DOCUMENTS

| | | | | |
|---|---|---|---|---|
| 3,788,284 | A * | 1/1974 | Gardner | 123/676 |
| 5,456,408 | A | 10/1995 | Appel | |
| 5,591,975 | A * | 1/1997 | Jack et al. | 250/338.5 |
| 6,939,396 | B2 * | 9/2005 | Petersson et al. | 96/130 |
| 7,001,445 | B2 * | 2/2006 | Petersson et al. | 95/11 |
| 2004/0039517 | A1 * | 2/2004 | Biesinger et al. | 701/117 |

FOREIGN PATENT DOCUMENTS

| | | | |
|---|---|---|---|
| DE | 3526462 | A1 | 1/1987 |
| DE | 4014499 | A1 | 10/1992 |
| DE | 4311080 | C1 | 3/1994 |
| DE | 19505846 | C2 | 12/1996 |
| DE | 19753733 | A1 | 6/1999 |
| DE | 10210035 | A1 | 9/2003 |

OTHER PUBLICATIONS

German Office Action dated Apr. 24, 2007.
International Search Report dated Oct. 5, 2007.

* cited by examiner

*Primary Examiner* — Willis Wolfe, Jr.
(74) *Attorney, Agent, or Firm* — Laurence A. Greenberg; Werner H. Stemer; Ralph E. Locher

(57) ABSTRACT

A method for operating a combustion machine, such as an internal combustion engine, has the following steps: provision of a combustion machine for producing thermal energy; operation of the combustion machine, and thereby burning fuel to obtain the thermal energy; detection of the concentration of at least one pollutant, which is produced during the combustion, in the surroundings of the combustion machine; regulation of the operation of the combustion machine, in which a characteristic variable of the combustion machine is set according to the detected concentration in such a way that the emission of the pollutant is reduced.

18 Claims, 1 Drawing Sheet

METHOD FOR OPERATING A COMBUSTION MACHINE, DEVICE FOR OBTAINING THERMAL ENERGY, AND MOTOR VEHICLE

BACKGROUND OF THE INVENTION

Field of the Invention

The present invention relates to a method for operating a combustion machine, to a device for obtaining thermal energy, and to a motor vehicle having said device.

A method and device of said type are used with preference in the motor-vehicle domain. The present invention and the issues associated therewith are therefore described below with reference to the automobile sector, without thereby limiting the invention exclusively thereto.

The need for electric energy is also growing with the increased use of electric and electronic components in motor vehicles. The need for electric energy during a motor vehicle's continuous operation is met substantially by way of a generator (dynamo) that is linked to the internal-combustion engine used for driving the motor vehicle.

The consumption of electric energy does not, though, end when the motor vehicle has been parked. Rather it is the case that the need to supply the vehicle's electrical distribution system with electric energy persists also in what is termed the key-off (standby) condition. For example the alarm system, stationary heating, clock, data memory, car telephone, immobilizer, locking device, or lighting will continue to consume electric energy even in the key-off condition, meaning with the ignition switched off. Said energy need is usually met from the car battery.

Said car battery will, however, be under a very heavy load especially when a multiplicity of electric consumers are consuming power in the key-off condition. The motor vehicle's standing time will hence also reduce with said consumers' increasing energy consumption in the key-off condition. The standing time refers to the time during which all the motor vehicle's functions can still be reliably maintained without the car battery's being discharged too far to continue insuring the motor vehicle's proper functions. The car battery must in particular have sufficient residual charge especially for supplying the starter with energy for starting the internal-combustion engine. There is hence always the need in a motor vehicle to keep its standing time as long as possible and nonetheless retain as far as possible all functions in the key-off condition.

An auxiliary power supply for the vehicle's electrical distribution system such as, for example, a catalytic micro burner, can be installed in the motor vehicle so that its standing time will be prolonged without causing the car battery to be discharged. The heat dissipated by the micro burner is converted via a connected thermogenerator into electric energy serving inter alia to power the vehicle's electrical distribution system in the key-off condition.

While a combustion machine, which can be embodied in the form of, for example, a micro burner, is operating, exhaust gases that are discharged into the environment are produced while the energy sources employed, such as diesel or gasoline, for example, are being burned. A micro burner can be used, for example, to convert the thermal energy produced by the micro burner via a connected thermogenerator into electric energy that in turn serves to power electric and electronic components in the motor vehicle or is fed into the vehicle's electrical distribution system.

Alongside harmless gases such as water vapor, the exhaust gases produced also in part contain more or less noxious gases such as, for example, sulfur dioxide, carbon monoxide, and also carbon dioxide. What is here to be understood by noxious gases is any gas that contains pollutants. Pollutants are substances which, for example, will impair a person's health or have a harmful effect on other living things also. Particulate matter such as soot, for instance, also contributes to polluting the environment and hence to possible harming if produced in significant quantities during combustion. The concentration of individual pollutants may exceed permissible thresholds when the combustion machine is operated in enclosed, poorly ventilated spaces such as, for example, a garage, particularly during prolonged operation. The thresholds are established such that, for example, no harm to a person's or other living thing's organism due to the pollutants is detectable below a threshold of said kind. Spending time in a space exhibiting a high pollutant concentration can then cause harm to the living thing. It will be especially critical if even lethal pollutant concentrations are produced during combustion.

Noxious gases or pollutants are subject to thresholds that are in part statutory and must not be exceeded or to which a person ought not to have prolonged exposure. A recognized threshold for pollutant contamination over a prolonged period is, in Germany, the maximum workplace concentration (maximale Arbeitsplatzkonzentration, abbreviated in German to MAK) of a pollutant.

No solution has yet been provided for reducing the concentration of pollutants in a combustion machine's immediate surroundings in order thereby not to jeopardize people's life and health. Only passive systems are known that will emit an alarm when a pollutant concentration has been exceeded within a space.

BRIEF SUMMARY OF THE INVENTION

It is therefore an object of the present invention to as far as possible avoid or at least reduce a noxious pollutant concentration while a combustion machine is operating.

Said object is achieved by means of a method having the features of claim 1 and/or a device having the features of claim 12 and/or a motor vehicle having the features of claim 16.

A method for operating a combustion machine is accordingly provided that comprises the following steps: Providing a combustion machine for producing thermal energy; operating the combustion machine, during which process fuels are burned for obtaining the thermal energy and their burning produces pollutants that are emitted into the environment; registering the concentration of at least one pollutant in the combustion machine's surroundings; regulating the combustion machine's operation, during which regulating a characteristic variable of the combustion machine is set as a function of the registered concentration in such a way that emission of the pollutant will be reduced.

Further provided is a device for obtaining thermal energy that comprises a combustion machine for producing thermal energy that additionally produces a pollutant, a device for registering a concentration of at least one pollutant, and a regulating device for regulating the combustion machine.

The idea underlying the present invention is to keep the pollutant concentration in a combustion machine's surroundings below a non-critical value by regulating the combustion process. Values below which no harm to, for example, people is detectable are regarded as non-critical.

The combustion process can therein be regulated or controlled as a function of one or more pollutants in the environment. Especially if there is no or an inadequate exchange of the ambient medium such as, for example, the air surrounding the combustion machine, a pollutant's concentration in the environment can owing to the emission of pollutants into said ambient medium attain values that may be hazardous to living things such as, for example, people. The emission of pollutants can be influenced and in particular appropriately reduced by adjusting the combustion process in the combustion machine to an extent that includes turning the combustion machine off.

Producing energy, which actually constitutes the combustion machine's main function, is accorded a lower priority during said regulating than maintaining or achieving specific non-critical pollutant concentrations in the ambient medium.

The method can hence be applied particularly to sectors where providing electric or mechanical energy does not always have top priority. Such sectors can include, for example, systems in which the combustion machine is not the only energy source such as, for instance, a motor vehicle that has a hybrid drive or auxiliary heating.

Advantageous embodiments and developments of the invention are the subject of the subclaims and of the description, with reference to the drawing.

What in the following is to be understood by the term "environment" are the combustion machine's immediate surroundings. Said immediate surroundings include the medium into which the combustion machine directly emits the exhaust combustion fumes containing pollutants. Said medium is, for example, the ambient air. But it is intended also for other media to be included such as, for instance, ambient water when the combustion machine is operated on a boat. The environment can, though, also include ambient demarcations such as, for example, the ground on which a combustion machine is standing and into which pollutants can also be emitted.

The environment can be an enclosed environment, a quasi enclosed environment, or an open environment. In the case of an enclosed environment there will be no exchange with other areas bordering it. So an emission of pollutants will in the case of an enclosed environment result relatively quickly in a change in concentration. In the case of a quasi enclosed environment there is a small possibility of an exchange with bordering areas, or the environment has a volume sufficiently large to take up a certain amount of pollutants without exhibiting a significant change in concentration, which, though, undergoes no exchange with the environment. Any changes in concentration in a quasi enclosed environment will therefore develop only slowly. In an open environment there will be a fast exchange of the medium with other areas so that any change in concentration due to the emission of pollutants into the environment can be ignored.

Examples of an enclosed environment are a closed garage or closed machine room. A slightly open or poorly ventilated garage could likewise serve as examples of a partially enclosed environment as could also a quite small, enclosed body of inland water not having and inlet or outlet. For example the open surroundings in nature or larger bodies of water and seas constitute an open environment. What is particularly to be understood by "environment" is the area that surrounds the combustion machine and in which living things, in particular people or animals, spend time or may do so. The ambient medium into which the pollutants are emitted in turn transfers the pollutants to the living things. They take up the pollutants by way of, for example, (breathed-in) air.

It is assumed that a pollutant's concentration is approximately constant in the environment and, though possibly changing through a further addition of pollutants, will display no great differences in concentration within short measuring intervals such as, for example, a few minutes. A pollutant's concentration is highest at a combustion machine's exhaust but will attain an approximately constant concentration as the ambient medium circulates accordingly. That average concentration of a pollutant in the environment is regarded as the pollutant's concentration in the environment. A pollutant's concentration in the environment is not intended to correspond to a maximum value that can occur locally.

A pollutant's concentration can be measured in an environment for example in a stationary manner at a representative location and conveyed to the device for obtaining thermal energy. Similarly to a fire alarm, a pollutant's concentration is measured not where the pollutant originates, which is to say at the site of combustion or where the pollutant is emitted into the environment, for example at an exhaust, but at a location suitable for measuring a concentration of the pollutant in the environment that corresponds to the average concentration of the pollutant in the environment or approximates to said average concentration.

What is to be understood in the following by an "internal-combustion engine" is a machine that directly converts the thermal energy resulting from burning a motor fuel or combustible substance into kinetic energy which can in turn be used for powering motor vehicles, for example.

The further-reaching term "combustion machine" is intended to encompass both an internal-combustion engine and, for example, a machine for producing thermal energy, with the thermal energy being used either directly for heating, for instance, or indirectly through conversion into, for example, electric energy. What is generally to be understood by a combustion machine is a machine in which a fuel is burned in a controlled manner, with its being possible to put the resulting thermal energy to all manner of uses.

What is understood in this context by "thermal energy" is the increase in a medium's thermal energy. The thermal energy released when a fuel is burned can be used to heat a medium such as air or water, for example. The thermal energy can, though, also be converted directly into kinetic energy.

The pollutants emitted by a combustion machine are extremely varied. What is herein to be understood by "pollutant" is a substance capable of having harmful effects on a living thing, in particular a person. While said harmful effects can arise even at low concentrations or after a short period of time, it can also take prolonged exposure or very high concentrations for the effects to become harmful to a living thing. Pollutants can also include gases that are not harmful to a living thing in low concentrations such as, for example, $CO_2$, which is produced by many living things themselves as an exhaust respiratory gas. The pollutants can be selected in particular from the group comprising $CO_2$, CO, $SO_2$, $SO_3$, $H_2S$, $NO_2$, NO, $N_2O$, $N_2O_4$, $NH_3$, ozone, formaldehyde, hydrocarbons, and particulate materials.

A sensor can inventively be employed for detecting a pollutant and determining its concentration in the environment. A sensor for a pollutant selected from the group comprising $CO_2$, CO, $SO_2$, $SO_3$, $H_2S$, $NO_2$, NO, $N_2O$, $N_2O_4$, $NH_3$, ozone, formaldehyde, hydrocarbons, and particulate materials is preferably employed for determining a pollutant's concentration in the environment.

According to another preferred development a pollutant's concentration in the combustion machine's surroundings is measured and conveyed wirelessly to a device for registering the pollutant's concentration in the device for obtaining thermal energy. A pollutant's concentration can be measured via, for example, a stationary measuring device at a representative location. The measuring device then makes the concentration data available to the registering device and hence to the regulating device via a radio link.

According to a preferred development of the present invention the combustion machine's performance is choked or reduced. The emission of pollutants by the combustion machine will be reduced when the performance is reduced. The rise in a pollutant's concentration in the environment can be reduced thereby or completely halted. That can be done if an upper limit for a pollutant's concentration is exceeded. A threshold for a concentration is pre-specified as such.

According to another preferred development of the present invention the combustion machine's pollutant emission can be completely halted if the combustion machine is switched off. That can be done if an upper limit for a pollutant's concentration is exceeded. The threshold on the exceeding of which the combustion machine will be switched off can be the same as or different from the threshold at which the combustion machine is choked in its performance.

For example the combustion machine's performance will be chocked if a first threshold for a concentration of at least one pollutant is exceeded and the combustion machine will be switched off completely if a further threshold for a concentration of at least one pollutant is exceeded.

Burning of the fuel in the combustion machine can according to another preferred development of the present invention be adjusted such that the emission of one or more pollutants will be reduced. That can be done preferably by adjusting or changing the pressure, temperature, air ratio λ, and/or mass flow in the combustion machine.

According to another preferred development of the present invention the combustion machine will be restored to its original performance or, as the case may be, switched on again if the concentration of the at least one pollutant falls below a lower threshold for a reduction in performance or, as the case may be, for switching the combustion machine off. The lower threshold can be below the upper threshold or the same as it. Through action of said kind it will be insured that the combustion machine can always offer its performance when the concentration of the at least one pollutant in the environment is below a pre-specified threshold.

A threshold of said type for the concentration of the at least one pollutant is preferably the pollutant's maximum workstation concentration. The maximum workstation concentration (MAK) specifies the maximum permissible concentration of a substance, in the form of gas, vapor, or suspended matter in the (breathed-in) air at the workstation, at which no hazard to health can be expected even in the event of exposure to the concentration for as a rule eight hours a day up to 40 hours a week. The thresholds can, though, also be workstation thresholds (abbreviated in German to AGW) or biological thresholds (abbreviated in German to BGW). A further preferred limiting concentration is a pollutant's maximum emission concentration (abbreviated in German to MIK).

According to a preferred development of the present invention the concentration of the at least one pollutant in the air, vacuum, water, or ground is determined.

According to another preferred development of the present invention the flow of exhaust gas from the combustion machine will if the concentration of the at least one pollutant in the environment is exceeded be ducted through a filter that filters the pollutant out.

The combustion machine is according to a preferred development of the present invention a micro burner and in particular a catalytic micro burner. The function of a micro burner of said type is to serve as an auxiliary energy source in a motor vehicle, for example, for providing electric energy. The thermal energy provided by the micro burner can be converted by a thermogenerator into electric energy. The thermal energy provided by a micro burner can also serve to heat a motor vehicle, which is to say as an auxiliary heating means.

BRIEF DESCRIPTION OF THE SEVERAL VIEWS OF THE DRAWING

The invention is explained in more detail below with the aid of the following exemplary embodiments and with reference to the figures.

Elements that are identical or functionally identical have unless indicated otherwise been assigned the same reference numerals in both figures in the drawing.

DESCRIPTION OF THE INVENTION

EXAMPLE 1

Figure 1:
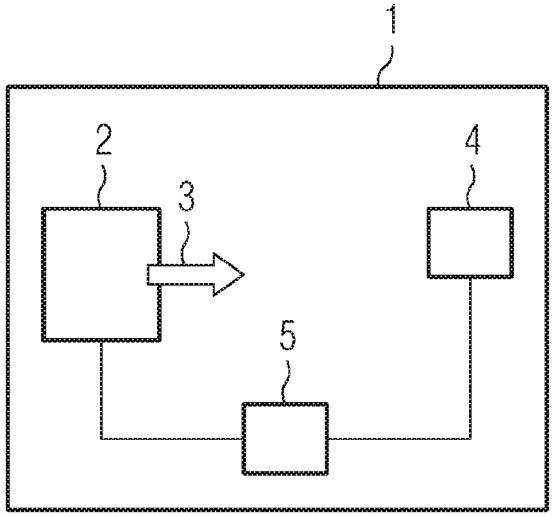
FIG. 1 shows a device for obtaining thermal energy according to an exemplary embodiment of the present invention.

FIG. 1 shows, for illustrating a first exemplary embodiment of the present invention, an inventive device for obtaining thermal energy.

FIG. 1 shows in an environment 1 a combustion machine 2 that emits a flow of exhaust gas 3 into the environment 1 when fuel is being burned. The concentration of pollutants produced and emitted by the combustion machine will thereby be increased in the environment 1. A sensor 4 measures the concentration of one or more pollutants in the environment 1. The resulting values are conveyed to an electronic control 5. The performance of the combustion machine 2 will be reduced if a threshold for at least one pollutant is exceeded. The combustion machine 2 can alternatively or additionally be switched off after a threshold for a concentration of the at least one pollutant has been exceeded.

EXAMPLE 2

Figure 2:
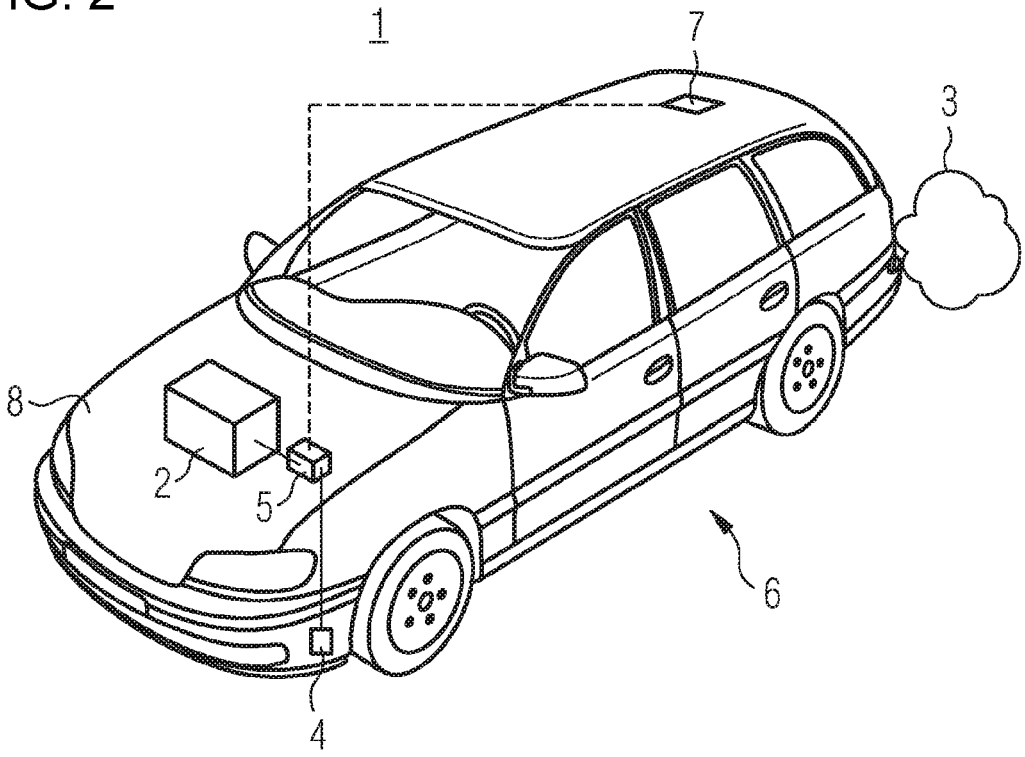
FIG. 2 shows a motor vehicle having a device for obtaining thermal energy according to another exemplary embodiment of the present invention.

FIG. 2 shows, for illustrating a second exemplary embodiment of the present invention, a motor vehicle having an inventive device for obtaining thermal energy.

Shown in FIG. 2 is a motor vehicle 6 located in whose engine compartment 8 is a combustion machine 2. Linked to the combustion machine is a regulating device 5 via which the combustion machine's operation is regulated. The regulating device is furthermore linked to a sensor 4.

A flow of exhaust gas 3 is emitted into the environment 1 when the combustion machine is operating. The concentration of a pollutant, for example $CO_2$, is measured via the sensor 4. The combustion engine will be switched off if an upper threshold for the concentration of $CO_2$ is exceeded. The concentration of $CO_2$ in the environment can drop again owing to the no longer present emission of $CO_2$ into the environment 1. The combustion engine will be switched on again if the concentration of $CO_2$ falls below a lower threshold.

In an alternative exemplary embodiment the concentration of $CO_2$ is conveyed to the regulating unit 5 via a receiving unit 7. The receiving unit 7 receives the data for the concentration of $CO_2$ from an external measuring device that has been set up in the environment and which transmits the concentration of $CO_2$ wirelessly to receive-ready receiving units in the environment.

EXAMPLE 3

When a catalytic micro burner is operated in a motor vehicle and has a thermogenerator connected to it that converts the micro burner's dissipated heat into electric energy, that can relieve supplying the vehicle's electrical distribution system via conventional sources such as, for example, a car battery. When the catalytic micro burner is operated in a motor vehicle parked in a closed garage, the concentration of at least one noxious gas can in the course of time exceed the maximum workstation concentration. Up to one liter of gasoline is burned within six days when a catalytic micro burner is operated. The gasoline therein has a heating value of 42 MJ/kg and a mean density of 0.74 kg/l. The micro burner's heating output is 60 watt. A carbon-to-hydrogen ratio of 1:2 is taken as a basis for gasoline.

2,222 g of $CO_2$ will accordingly be produced when 1 liter of gasoline is burned. Given a density of 1.98 g/l, that corresponds to 1,173 liters of $CO_2$. If a mean volume of 28,187 liters is then taken as the basis for a single garage, the $CO_2$ content in the garage after six days will be 4 vol. %. The MAK value for $CO_2$ is 0.5 vol. %. The concentration of $CO_2$ in the garage after six days will hence be approximately eight times the value for the maximum workstation concentration. The natural value for the $CO_2$ concentration is around 0.04 vol. %.

EXAMPLE 4

A hybrid motor vehicle is fitted with both an internal combustion engine and an electric drive. The electric drive obtains its electric energy from a hydrogen fuel cell. The motor vehicle is furthermore fitted with a receiver for data about concentrations of different pollutants in the environment. Data about concentrations of pollutants in the environment is received via said receiver. The motor vehicle's drive will be switched over to the electric drive if a pollutant's concentration exceeds a threshold so that the motor vehicle will emit no further pollutants into the environment. The internal combustion engine can be switched on again once the pollutants' concentration has again dropped below a lower threshold.

Although described above using preferred exemplary embodiments, the present invention is not limited thereto but can be modified in multifarious ways.

The invention is thus not to be seen as limited to the features presented in the above examples and figures. Said features can rather be modified in any manner without departing from the invention's underlying principle. Thus measuring, for instance, is not limited to noxious gases in the air but can be extended also to include pollutants in, for example, water. A plurality of pollutants can also be monitored simultaneously and the combustion machine appropriately reduced in its performance or switched off if a concentration of one of the pollutants is exceeded. The $CO_2$ concentration in the garage can be measured via a $CO_2$-measuring station that has been set up in the garage and then conveys the measured values to a receiving device in the device for producing thermal energy. It is in particular not essential for the electric drive to obtain electric energy from a hydrogen fuel cell; it can also obtain it from a rechargeable or non-rechargeable battery. It is conceivable also for the motor vehicle's internal-combustion engine not to be switched off when a threshold is exceeded but, instead, for the flow of exhaust gas to be ducted via a filter, for example a filter for $CO_2$ that contains calcium oxide or calcium hydroxide, and the emission of $CO_2$ into the environment to be prevented or reduced thereby. It is conceivable also not to be concerned with a motor vehicle in a garage but with a boat on a lake. The concentration of pollutants in the lake must therein not exceed specific values. The performance of the boat's internal-combustion engine will be choked if said values are exceeded.

The invention claimed is:

1. A device for obtaining thermal energy, comprising:

a combustion machine configured to burn a fuel and generate thermal energy;

a registering device for registering a concentration of at least one pollutant produced during an operation of the combustion machine and emitted into the environment; and a closed-loop control device for regulating the combustion machine, wherein a characteristic variable of said combustion machine is set in dependence on a registered concentration to cause an emission of the pollutant to be reduced;

wherein said combustion machine is an auxiliary energy source for providing electric energy and/or a micro burner.

2. The device according to claim 1, wherein said registering device has a receiver and an evaluation device, said receiver being configured to accept a signal sent from a transmitter and containing information about the concentration of the pollutant, and wherein said evaluation device is configured to determine the concentration of the pollutant from the received signal.

3. The device according to claim 1, wherein said combustion machine is a catalytic micro burner.

4. The device according to claim 1, wherein said registering device is a measuring device having a sensor for measuring the concentration of the pollutant in a surrounding of said combustion machine.

5. The device according to claim 4, wherein said sensor is disposed to measure the concentration of the pollutant in an ambient air surrounding said combustion machine.

6. A motor vehicle, comprising:

a device according to claim 1, wherein said combustion machine is an internal combustion engine disposed in an engine compartment of the motor vehicle; and said registering device is disposed on the motor vehicle to register the concentration of the pollutant in the surroundings of the motor vehicle.

7. The motor vehicle according to claim 6 configured as a passenger car.

8. A method for operating a combustion machine, which comprises the following steps:

providing a combustion machine for producing thermal energy;

operating the combustion machine by combusting a fuel and obtaining thermal energy;

registering a concentration of at least one pollutant in a surrounding of the combustion machine; and controlling an operation of the combustion machine with closed-loop control, and thereby setting a characteristic variable of the combustion machine in dependence on the concentration determined in the registering step such that an emission of the at least one pollutant will be reduced;

wherein the combustion machine is a micro burner and/or an auxiliary energy source in a motor vehicle for providing electric energy.

9. The method according to claim 8, wherein the pollutant is selected from the group consisting of $CO_2$, CO, $SO_2$, $SO_3$, $H_2S$, $NO_2$, NO, $N_2O$, $N_2O_4$, $NH_3$, ozone, formaldehyde, hydrocarbons, and particulate matter.

10. The method according to claims 8, wherein the step of registering comprises measuring the concentration of the at least one pollutant with a sensor.

11. The method according to claim 8, which comprises transmitting the concentration of the at least one pollutant in the environment to a receiver for the combustion machine with a transmitter.

12. The method according to claim 8, wherein the registering step comprises determining the concentration of the at least one pollutant in the ambient air.

13. The method according to claim 8, wherein the combustion machine is a catalytic micro burner.

14. The method according to claim 8, which comprises, if the concentration of at least one pollutant exceeds a pre-specified upper threshold, adjusting a combustion process in the combustion machine such that an emission of the said pollutant is reduced.

15. The method according to claim 14, wherein the adjusting step comprises changing at least one of a pressure, a temperature, an air ratio $\lambda$, and a mass flow.

16. The method according to claim 8, which comprises reducing a power of the combustion machine, or switching the combustion machine off, if the concentration of at least one pollutant exceeds a pre-specified upper threshold.

17. The method according to claim 16, which comprises resetting the power of the combustion machine to an initial value if the concentration falls below a pre-specified lower threshold.

18. The method according to claim 16, wherein the upper threshold and/or a lower threshold for the concentration is defined by a maximum acceptable workplace concentration of the pollutant.

* * * * *